US010286402B2

(12) United States Patent
Fujimori

(10) Patent No.: US 10,286,402 B2
(45) Date of Patent: May 14, 2019

(54) SHREDDER

(71) Applicant: Nakabayashi Co., Ltd., Osaka-shi, Osaka (JP)

(72) Inventor: Shigeru Fujimori, Matsue (JP)

(73) Assignee: NAKABAYASHI CO., LTD., Osaka (JP)

( * ) Notice: Subject to any disclaimer, the term of this patent is extended or adjusted under 35 U.S.C. 154(b) by 412 days.

(21) Appl. No.: 15/160,298

(22) Filed: May 20, 2016

(65) Prior Publication Data

US 2016/0339442 A1 Nov. 24, 2016

(30) Foreign Application Priority Data

May 22, 2015 (JP) ..... 2015-104841

(51) Int. Cl.
*B02C 18/18* (2006.01)
*B02C 18/00* (2006.01)
*B02C 18/22* (2006.01)

(52) U.S. Cl.
CPC ..... *B02C 18/0007* (2013.01); *B02C 18/18* (2013.01); *B02C 18/2283* (2013.01); *B02C 2018/2208* (2013.01)

(58) Field of Classification Search
CPC ... B02C 18/0007; B02C 18/18; B02C 18/182; B02C 18/184; B02C 18/22; B02C 18/225; B02C 18/2283
USPC ..... 241/159, 236
See application file for complete search history.

(56) References Cited

U.S. PATENT DOCUMENTS 3,837,586 A * 9/1974 Perschbacher ..... B02C 18/148 198/780
4,192,467 A * 3/1980 Hatanaka ..... B02C 18/0007 241/100
4,230,282 A * 10/1980 Haase ..... B02C 18/0084 241/159
4,381,107 A * 4/1983 Armiger ..... B65H 35/02 270/21.1

(Continued)

FOREIGN PATENT DOCUMENTS

JP 2002-18302 1/2002

OTHER PUBLICATIONS

US, Office Action, U.S. Appl. No. 15/288,294 (dated Jan. 10, 2019).

*Primary Examiner* — Shelley M Self
*Assistant Examiner* — Jared O Brown
(74) *Attorney, Agent, or Firm* — Thompson Hine LLP

(57) ABSTRACT

A shredder includes a strip-cut shredding portion including paired disc-shaped multi-plate rotary cutters to be engaged with each other to shred paper in a strip-cut direction, and a cross-cut shredding portion including a fixed cutter and a spiral rotary cutter for further shredding strip-cut waste pieces discharged from the strip-cut shredding portion in a cross-cut direction, the shredder including an intermediate holding portion, between the strip-cut shredding portion and the cross-cut shredding portion, for feeding the strip-cut waste pieces to the cross-cut shredding portion while holding the strip-cut waste pieces. The intermediate holding portion includes paired rollers which have outer peripheral faces capable of coming into close contact with each other to pinch the strip-cut waste pieces, and which rotate in feed directions.

4 Claims, 4 Drawing Sheets

(56) References Cited

U.S. PATENT DOCUMENTS

| | | | | |
|---|---|---|---|---|
| 4,768,432 | A * | 9/1988 | Storlie | B02C 18/0007 100/89 |
| 6,612,213 | B1 * | 9/2003 | Bredenberg | B65H 29/40 271/300 |
| 6,997,408 | B2 | 2/2006 | Watano et al. | |
| 7,311,276 | B2 | 12/2007 | Matlin | |
| 7,383,842 | B1 | 6/2008 | Sabol | |
| 7,490,789 | B2 * | 2/2009 | Omi | B02C 18/0007 241/225 |
| 7,520,452 | B2 | 4/2009 | Watano et al. | |
| RE44,161 | E | 4/2013 | Matlin | |
| 8,967,509 | B2 | 3/2015 | Tso | |
| 10,086,380 | B2 | 10/2018 | Yamamoto | |
| 2002/0023977 | A1 | 2/2002 | Nakagomi | |
| 2005/0072870 | A1 | 4/2005 | Dziesinski | |
| 2006/0175444 | A1 | 8/2006 | Chen | |
| 2010/0243774 | A1 | 9/2010 | Hu | |
| 2010/0327091 | A1 | 12/2010 | Ko | |

* cited by examiner

SHREDDER

TECHNICAL FIELD

The disclosure relates to paper shredders having a strip-cut shredding portion and a cross-cut shredding portion, and particularly to a paper shredder in which a holding portion for strip-cut waste pieces is provided between the strip-cut shredding portion and the cross-cut shredding portion on a discharge side of the strip-cut shredding portion in order to cut final cut waste pieces discharged at final paper shredding into short lengths.

BACKGROUND

Conventionally, for the purpose of reducing a shred size of paper shredder waste pieces (shredder dust), there has been developed a shredder which strip-cuts paper into a plurality of parallel pieces and then further cross-cuts the pieces. In Japanese Examined Utility Model Application Publication No. 48-13990, pull-in rollers are provided on a discharge side of a strip-cut shredding portion and the pull-in rollers tear the strip-cut waste pieces discharged from the strip-cut shredding portion. However, tearing does not result in the constant shred size and some types of paper cannot be torn. Therefore, a shredder as shown in Japanese Unexamined Patent Application Publication No. 2002-18302 and including a cross-cut shredding portion on a discharge side of a strip-cut shredding portion is employed at present.

FIG. 3 illustrates a main part of a conventional paper shredder. The shredder includes a strip-cut shredding portion 10 that engages paired disc-shaped multi-plate rotary cutters 11, 12 with each other to strip-cut paper P passing through the engaged portion into many long and narrow noodle shaped strip-cut waste pieces Q1 with predetermined widths, each of the cutters 11, 12 having a large number of disc-shaped cutters disposed on a rotary drive shaft, and a cross-cut shredding portion 20 that has a spiral rotary cutter 21 with spirally-arranged shredding blades and a flat-blade cross-cut fixed cutter 22 facing the spiral rotary cutter 21 and which further finely cross-cuts (chops) the strip-cut waste pieces Q1 discharged from the strip-cut shredding portion 10. The strip-cut shredding portion 10 and the cross-cut shredding portion 20 as main parts form a shredding mechanism.

According to this shredder, the noodle-shaped strip-cut waste pieces Q1 discharged from the strip-cut shredding portion 10 are normally cross-cut when cutting edges of the spiral rotary cutter 21 of the downstream cross-cut shredding portion 20 pass by the cross-cut fixed cutter 22 due to rotation, and rectangular shredder waste pieces Q2 are discharged as illustrated in FIG. 3. Lengths of the shredder waste pieces Q2 are determined based on a feed speed by the disc-shaped multi-plate rotary cutters 11, 12, a rotating speed of the spiral rotary cutter 21, and the number of blades of the spiral rotary cutter 21.

In the above described structure, when the noodle shaped strip-cut waste pieces Q1 are then shredded into the rectangular shredder waste pieces Q2, base end sides (upper sides) of the strip-cut waste pieces Q1 are held by the engaged portion of the paired disc-shaped multi-plate rotary cutters 11, 12 of the strip-cut shredding portion 10 (FIG. 3). However, at a final shredding stage of the paper P, as illustrated in FIG. 4, final strip-cut waste pieces (hereinafter referred to as "final cut waste pieces") Q3 after completion of strip cutting of a remaining part of the paper are freed from the strip-cut shredding portion 10 and drop without being cross cut as soon as the base ends of the pieces Q3 (an upper edge of the paper P) separate from the engaged portion.

Therefore, from the conventional shredder, the final cut waste pieces Q3 are discharged as the waste pieces longer than the shredder waste pieces Q2 discharged before. To put it concretely, the final cut waste pieces Q3 have lengths corresponding to distance X1 from the engaged portion of the paired disc-shaped multi-plate rotary cutters 11, 12 to the cutting edge of the fixed cutter 22 in FIG. 4 and are twice the shredder waste pieces Q2 discharged before or greater in length.

As described above, the shred size at the final stage of the shredding is large in the conventional shredder, which increases a volume of the entire shredder waste. The increase in the shred size may affect confidentiality of these parts of the paper.

SUMMARY

The present invention has been made in view of the above described problems and an object thereof is to disclose a structure for reducing a shred size at a final stage of shredding in a shredder including a strip-cut shredding portion and a cross-cut shredding portion.

In order to achieve the above described object, an embodiment of the present invention provides a shredder which includes a strip-cut shredding portion having paired disc-shaped multi-plate rotary cutters to be engaged with each other to shred paper in a strip-cut direction, and, on a downstream side of the strip-cut shredding portion, a cross-cut shredding portion including a fixed cutter and a spiral rotary cutter for further shredding strip-cut waste pieces discharged from the strip-cut shredding portion in a cross-cut direction, the shredder including an intermediate holding portion, provided between the strip-cut shredding portion and the cross-cut shredding portion, for feeding the strip-cut waste pieces to the cross-cut shredding portion while holding the strip-cut waste pieces.

With this structure, it is possible to obtain shredder waste pieces of the same shred size as in the related art until a final stage of shredding. After the final strip-cut waste pieces (final cut waste pieces) separate from the strip-cut shredding portion at the final stage of the shredding, base ends of the final cut waste pieces are held by the intermediate holding portion and therefore the final cut waste pieces are also cross cut by the cross-cut shredding portion. Because the intermediate holding portion is positioned at a shorter distance from the cross-cut shredding portion than the strip-cut shredding portion, this difference in distance can make lengths of the final cut waste pieces smaller than those in the related art.

Specifically, the intermediate holding portion includes paired rollers which have smaller diameters than those of the respective paired disc-shaped multi-plate rotary cutters and outer peripheral faces capable of coming into close contact with each other to pinch the strip-cut waste pieces, and which rotate in feed directions. With this structure, by pinching of the strip-cut waste pieces between the outer peripheral faces of the paired rollers, it is possible to feed the pieces to the cross-cut shredding portion while holding them. Moreover, because the diameters of the rollers are smaller than those of the disc-shaped multi-plate rotary cutters, the distance between the intermediate holding portion and the cross-cut shredding portion is shorter than that between the strip-cut shredding portion and the cross-cut shredding portion in the related art even if the intermediate holding portion is provided between the strip-cut shredding portion and the cross-cut shredding portion, and therefore it is possible to obtain the shorter final cut waste pieces than in the related art.

The intermediate holding portion pinches the strip-cut waste pieces between the paired rollers on a tangent passing through an engaged portion of the paired disc-shaped multi-plate rotary cutters to thereby smoothly feed the cross-cut waste pieces to the cross-cut shredding portion.

Moreover, a guide portion capable of guiding the strip-cut waste pieces into a correct discharge direction between the paired rollers is provided between the intermediate holding portion and the strip-cut shredding portion, and thus it is possible to more reliably pinch the strip-cut waste pieces between the paired rollers.

When power transmitting gears for transmitting rotary power of the disc-shaped multi-plate rotary cutters to the rollers are provided between the disc-shaped multi-plate rotary cutters and the rollers, and the rollers are formed to rotate in the feed directions at higher circumferential speeds than those of the disc-shaped multi-plate rotary cutters via the power transmitting gears, a feed speed by the rollers becomes higher than that by the disc-shaped multi-plate rotary cutters. Due to this difference in speed, the strip-cut waste pieces discharged from the disc-shaped multi-plate rotary cutters are pulled toward the rollers and prevented from staying between the disc-shaped multi-plate rotary cutters and the rollers.

The strip-cut shredding portion may reversely rotate the disc-shaped multi-plate rotary cutters in directions reverse from shredding directions in some cases, due to a paper jam. In the structure provided with the power transmitting gears, if the rollers are formed to rotate in synchronization with the disc-shaped multi-plate rotary cutters both in the normal and reverse directions, at the final stage of shredding, the rollers rotate reversely to return the final cut waste pieces to the strip-cut shredding portion when the disc-shaped multi-plate rotary cutters are rotated reversely after the final cut waste pieces separate from the disc-shaped multi-plate rotary cutters, and the rollers may not be able to pinch the final cut waste pieces again to cross-cut them in the next normal rotation. Therefore, in the present invention, one-way clutches are provided between the paired rollers and the power transmitting gears, the rollers are rotated in the feed directions when the multi-plate disc-shaped rotary cutters rotate normally, and the one-way clutches interrupt power transmission to cause the rollers to rotate freely when the disc-shaped multi-plate rotary cutters rotate reversely. In this way, the rollers do not rotate reversely in synchronization with the multi-plate disc-shaped rotary cutters when the cutters rotate reversely and are kept holding the final cut waste pieces so as to be able to feed the pieces to the cross-cut shredding portion in the next normal rotation, which avoids the above described inconvenience.

If the disc-shaped multi-plate rotary cutters are rotated reversely in a state in which both of the disc-shaped multi-plate rotary cutters and the rollers are biting into the strip-cut waste pieces, the rollers in the freely rotating state rotate reversely in tandem with pulling in of the strip-cut waste pieces by the disc-shaped multi-plate rotary cutters, which resolves the biting into the pieces by the rollers.

According to embodiments of the disclosed device, at least one of the paired rollers is resiliently variable in force for coming in close contact with the outer peripheral face of the other roller. With this structure, a distance between the outer peripheral faces of the paired rollers is adjusted according to a thickness of the strip-cut waste pieces and it is possible to more reliably feed the strip-cut waste pieces to the cross-cut shredding portion while preventing the paper jam.

According to one aspect of the disclosed device, because the intermediate holding portion for the shredder waste pieces is provided between the strip-cut shredding portion and the cross-cut shredding portion, it is possible to reduce a shred size of the final cut waste pieces to thereby suppress a volume of the shredder waste and more reliably maintain confidentiality of waste documents.

DETAILED DESCRIPTION

Figure 1:
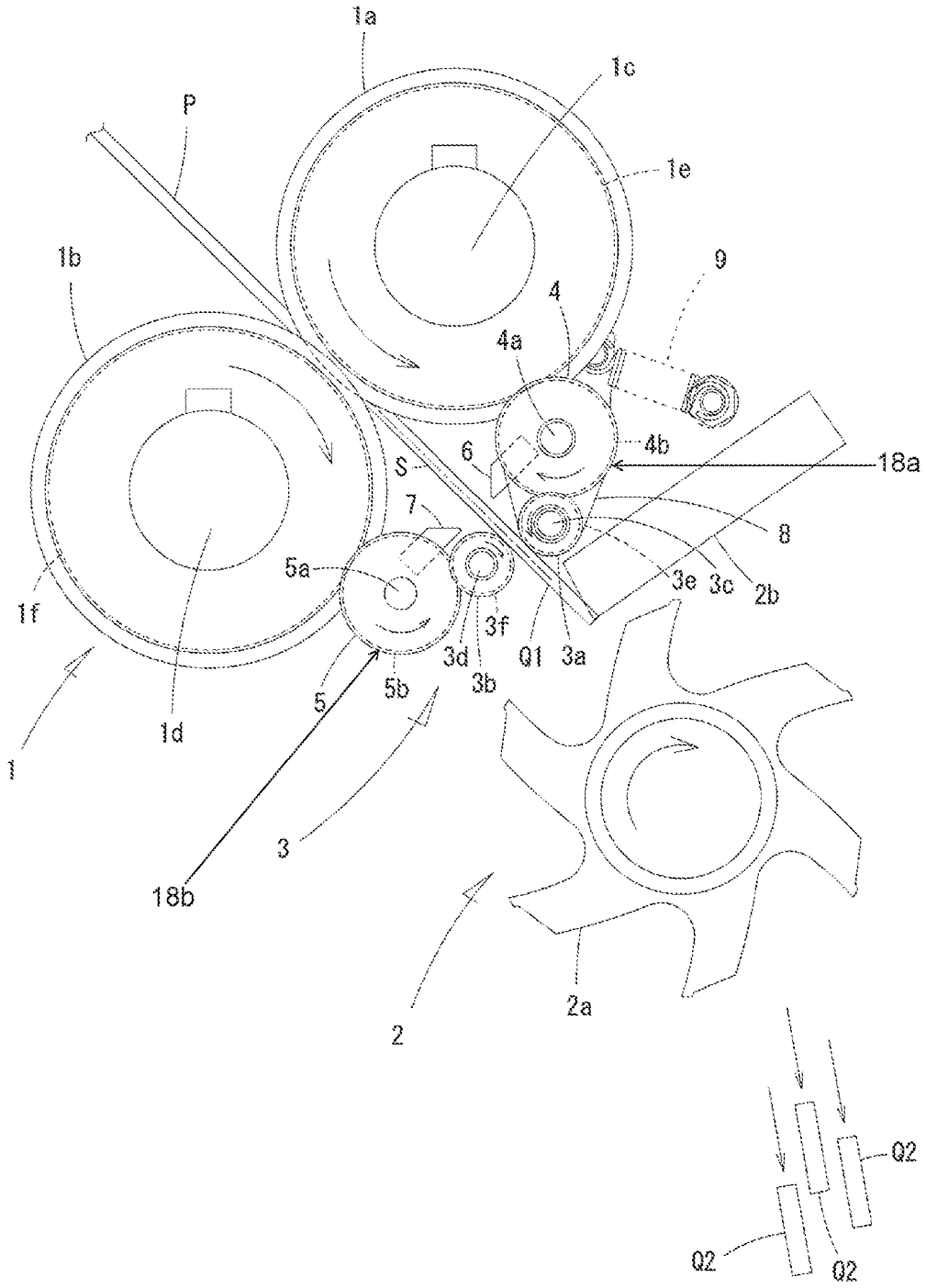
FIG. 1 is an explanatory diagram illustrating a main part of a shredder according to an embodiment.

An embodiment of the disclosed shredder is discussed below with reference to the accompanying drawings. FIG. 1 illustrates a main part of an embodiment of the disclosed shredder. Reference 1 designates a strip-cut shredding portion, 2 designates a cross-cut shredding portion, and 3 designates an intermediate holding portion for strip-cut shredder waste pieces provided between the strip-cut shredding portion 1 and the cross-cut shredding portion 2.

The strip-cut shredding portion 1 is formed by disposing paired disc-shaped multi-plate rotary cutters 1*a*, 1*b* so that the cutters 1*a*, 1*b* rotate in directions for feeding paper P with their blades engaged with each other. The strip-cut shredding portion 1 shreds the paper P passing through the engaged portion in a strip-cut direction into noodle shaped long and narrow strip-cut waste pieces Q1.

The cross-cut shredding portion 2 includes a spiral rotary cutter 2*a* having a plurality of cutting edges and a fixed cutter 2*b* having a cutting edge positioned on an orbit of rotation of the spiral rotary cutter 2*a*. The cross-cut shredding portion 2 further shreds in a cross cut direction (cross-cuts) the strip-cut waste pieces Q1 discharged from the strip-cut shredding portion 1 by means of the spiral rotary cutter 2*a* and the fixed cutter 2*b*.

On the other hand, the intermediate holding portion 3, which is a characteristic portion of this embodiment of the shredder, feeds the strip-cut waste pieces Q1 discharged from the strip-cut shredding portion 1 to the cross-cut shredding portion 2 while holding the strip-cut waste pieces Q1. In this embodiment, paired rollers 3*a*, 3*b* have diameters sufficiently smaller than those of the disc-shaped multi-plate rotary cutters 1*a*, 1*b* of the strip-cut shredding portion 1. The paired rollers 3*a*, 3*b* rotate to feed the strip-cut waste pieces Q1 to the cross-cut shredding portion 2 while bringing their outer peripheral face into close contact with each other to pinch the strip-cut waste pieces Q1.

These rollers 3*a*, 3*b* are rotated by rotary power of the disc-shaped multi-plate rotary cutters 1*a*, 1*b* of the strip-cut shredding portion 1. Paired power transmitting gears 4, 5 are provided between the intermediate holding portion 3 and the strip-cut shredding portion 1. To put it more concretely, gear portions 3*e* and 3*f*, 1*e* and 1*f*, and 4*b* and 5*b*, adjacent ones of which are engaged with each other, are provided to rotary drive shafts 3*c* and 3*d*, 1*c* and 1*d*, and 4*a* and 5*a* of the rollers 3*a*, 3*b*, the disc-shaped multi-plate rotary cutters 1*a*, 1*b*, and the power transmitting gears 4, 5, respectively. These gear portions transmit the rotary power of the disc-shaped multi-plate rotary cutters 1*a*, 1*b* to the rollers 3*a*, 3*b* via the power transmitting gears 4, 5 to synchronously rotate the rollers 3*a*, 3*b* in the feed directions.

Moreover, a feed speed (circumferential speed) by the rollers 3*a*, 3*b* is set to be higher than that by the disc-shaped multi-plate rotary cutters 1*a*, 1*b* by means of gear ratios of the gear portions. Due to this difference in speed, the strip-cut waste pieces Q1 discharged from the engaged portion of the disc-shaped multi-plate rotary cutters 1*a*, 1*b* are pulled toward the rollers 3*a*, 3*b* and prevented from staying between the strip-cut shredding portion 1 and the intermediate holding portion 3.

The number of each of power transmitting gears 4, 5 to each of the rollers 3*a*, 3*b* is not necessarily one but may be three or a greater odd number. If the number is two or another even number, the power transmitting gears 4, 5 rotate the roller 3*a*, 3*b* in reverse directions from the feed directions that is not preferable.

Moreover, portions of the outer peripheral faces of the rollers 3*a*, 3*b* which come into close contact with each other to pinch the strip-cut waste pieces Q1 are positioned on tangent S passing through the engaged portion of the disc-shaped multi-plate rotary cutters 1*a*, 1*b*. In this way, it is possible to feed the strip-cut waste pieces Q1 discharged from the strip-cut shredding portion 1 while more reliably pinching the strip-cut waste pieces Q1 between the rollers 3*a*, 3*b*.

Guide portions 6, 7 capable of guiding the strip-cut waste pieces Q1 into a correct discharge direction between the paired rollers 3*a*, 3*b* are provided, facing each other, between the intermediate holding portion 3 and the strip-cut shredding portion 1. Edge portions of the guide portions 6, 7 which face each other form a substantially V-shaped passage hole.

The one roller 3*a* out of the rollers 3*a*, 3*b* is provided with a movable axle bearing 8 for turning about the rotary drive shaft 4*a* of the corresponding power transmitting gear 4 so that the one roller 3*a* comes into contact with and separates from the other roller 3*b*. An extension coil spring 9 is connected to a base end portion of the movable axle bearing 8 so as to be able to resiliently change a force for bringing the roller 3*a* into close contact with the outer peripheral face of the roller 3*b*.

The shredder according to the embodiment is similar to the conventional shredder in that the strip-cut shredding portion 1 and the cross-cut shredding portion 2 discharge the rectangular shredder waste pieces Q2 having certain widths and certain lengths until the final shredding stage as illustrated in FIG. 1.

Figure 2:
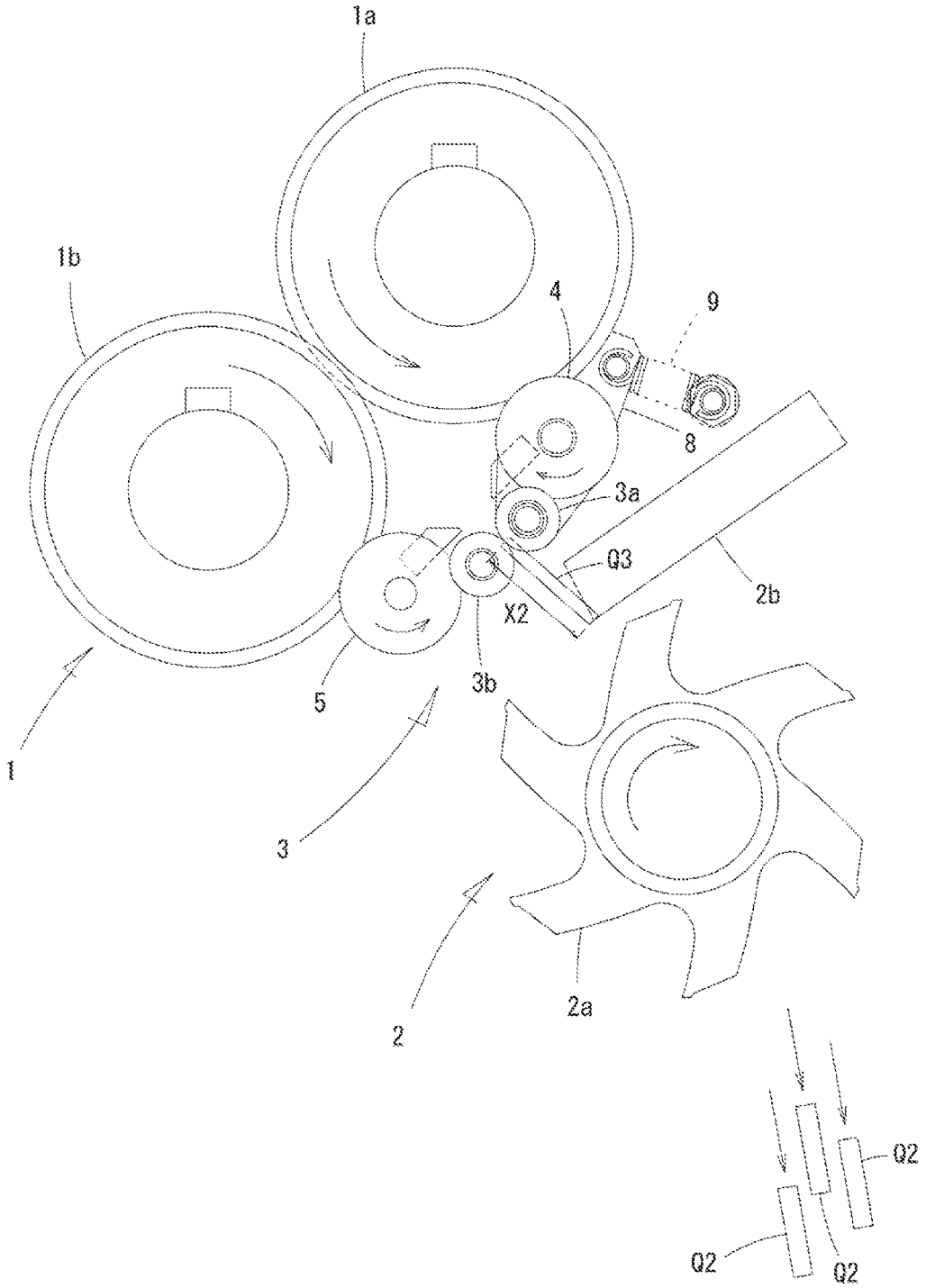
FIG. 2 is an explanatory diagram illustrating a state at a final stage of shredding of the shredder.
Figure 3:
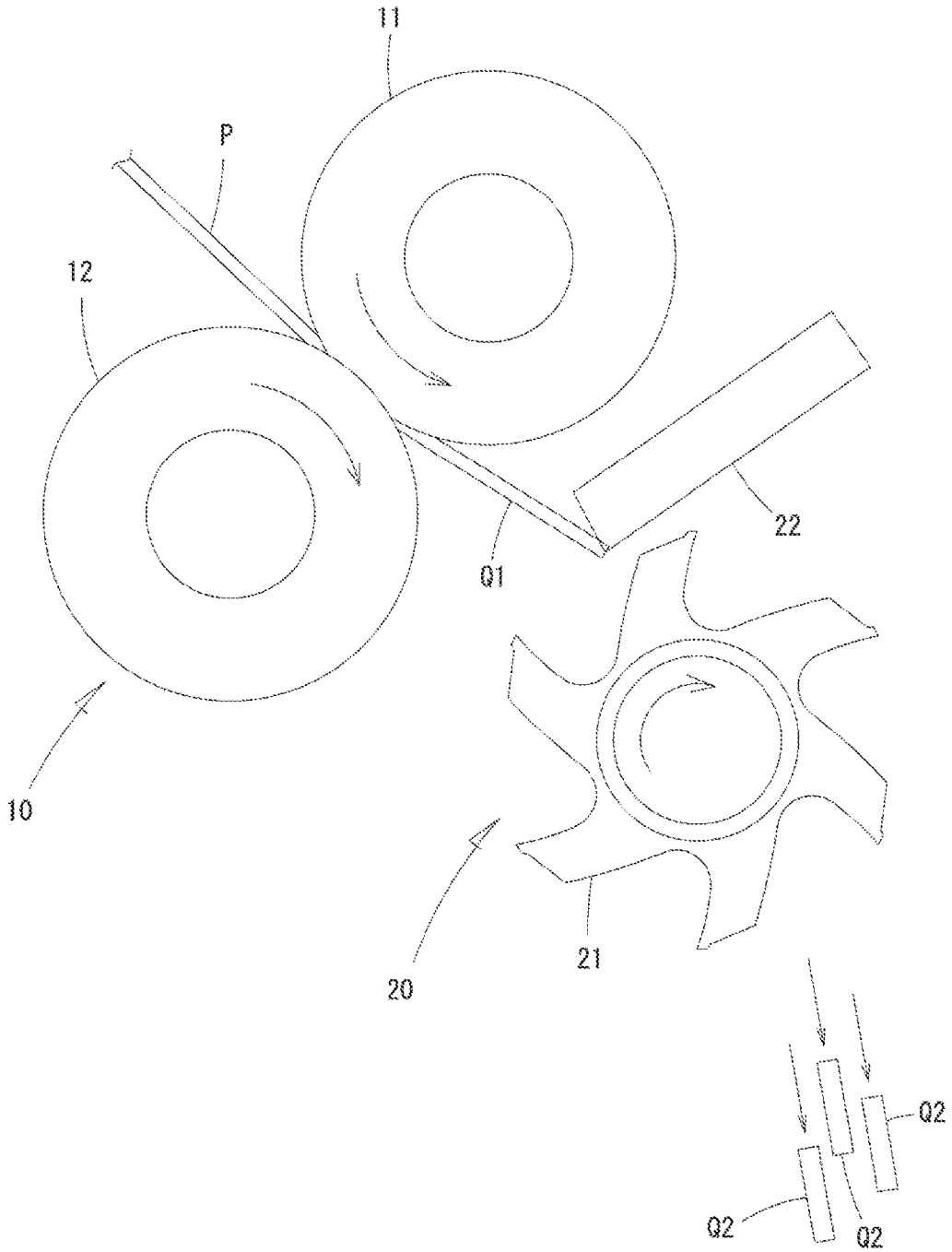
Fig. 3 PRIOR ART
FIG. 3 is an explanatory diagram illustrating a main part of a conventional shredder.

At the final shredding stage at which the paper pieces separate from the strip-cut shredding portion 1 in the feed direction, the final cut waste pieces Q3 which have separated from the strip-cut shredding portion 1 are held by the intermediate holding portion 3 and cross cut by the cross-cut shredding portion 2 until the final cut waste pieces Q3 separate from the intermediate holding portion 3 as illustrated in FIG. 2.

Figure 4:
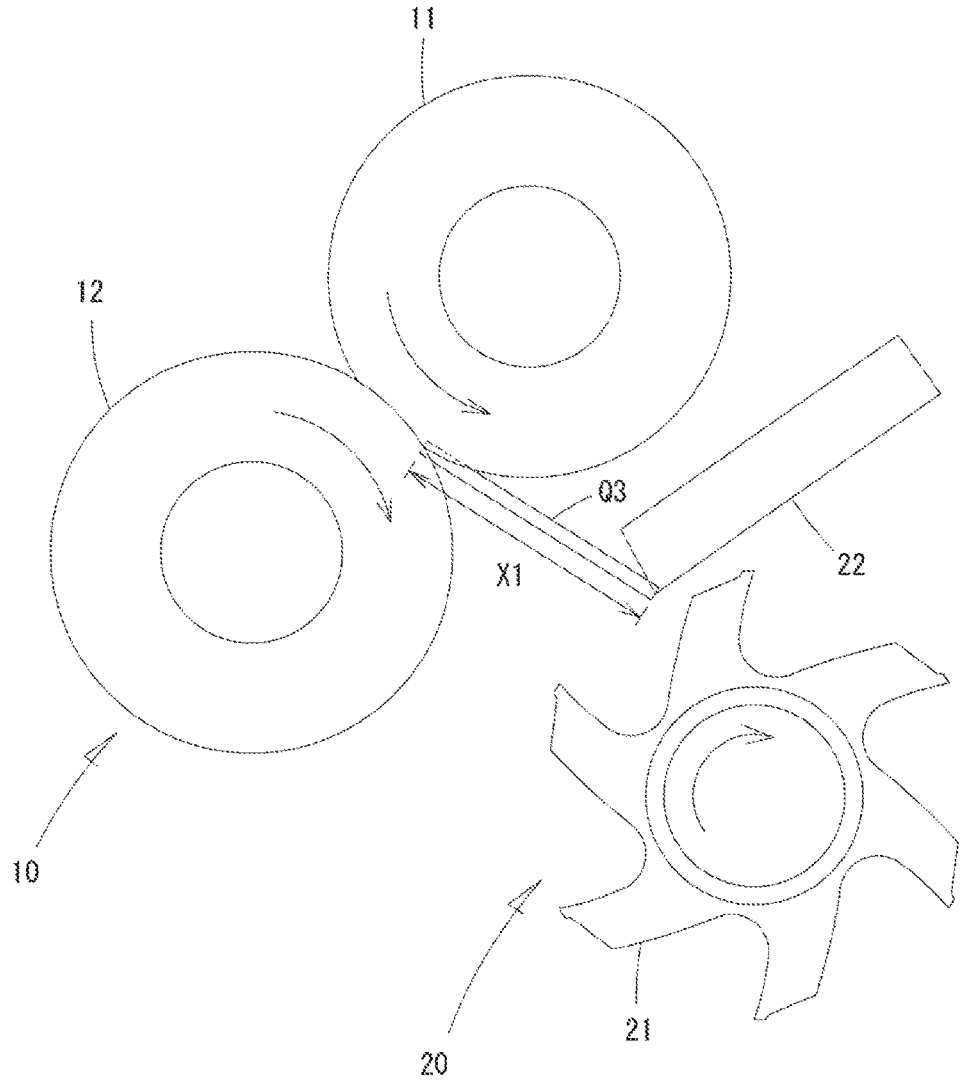
Fig. 4 PRIOR ART
FIG. 4 is an explanatory diagram showing a state at a final stage of shredding of the conventional shredder.

In other words, the final cut waste pieces Q3 in the embodiment have lengths corresponding to distance X2 from a pinching portion (contact portion) of the rollers 3*a*, 3*b* of the intermediate holding portion 3 to the cutting edge of the fixed cutter 2*b* of the cross-cut shredding portion 2. Since distance X2 is shorter than distance X1 in FIG. 4 illustrating the conventional shredder, it is possible to obtain the final cut waste pieces Q3 having shorter lengths in the embodiment as compared with the conventional shredder. Incidentally, if the lengths of the shredder waste pieces Q2 are 14 mm, distance X2 in FIG. 2 is 18.4 mm and distance X1 in FIG. 4 is 37.8 mm and therefore, it is possible to achieve the lengths of the final cut waste pieces Q3 shorter than or equal to half those in the related art. However, the numerical values are merely examples and may be changed depending on diameters and a layout of disc-shaped multi-plate rotary cutters, rollers, and the like.

Transmission of the power to the rollers 3*a*, 3*b* are preferably carried out by only normal rotations in the feed directions. For this purpose, the rollers 3*a*, 3*b* and the power transmitting gears 4, 5 are connected with one-way clutches 18*a*, 18*b* interposed therebetween and the clutches are disengaged to bring the rollers 3*a*, 3*b* into freely rotating states when the disc shaped multi-plate rotary cutters 1*a*, 1*b* rotate reversely.

Although the roller 3*a* on an upper side in the drawings out of the paired rollers 3*a*, 3*b* is made variable in angle by the movable axle bearing 8 in the embodiment, the lower roller 3*b* may be made variable in angle as well by means of a movable axle bearing portion 8 having the same structure. The present invention also includes making only the lower roller 3*b* variable in angle.

The layout of the strip-cut shredding portion 1 and the cross-cut shredding portion 2 is not limited to that in the above-described embodiment. In other words, in the above described embodiment, the disc-shaped multi-plate rotary cutters 1*a*, 1*b* are disposed diagonally, and the fixed cutter 2*b* of the cross-cut shredding portion 2 is disposed substantially perpendicularly to a discharge direction of the strip-cut waste pieces Q1. However, change of an angle of inclination of the strip-cut shredding portion 1 and the cross-cut shredding portion 2 while maintaining a relationship between their positions is a matter of design choice. To put it concretely, the present invention includes a layout in which disc-shaped multi-plate rotary cutters 1*a*, 1*b* are disposed bilaterally symmetrically to discharge strip-cut waste pieces Q1 in a vertical direction and a fixed cutter 2*b* is disposed horizontally. In this case, paired rollers 3*a*, 3*b* of an intermediate holding portion 3 are disposed bilaterally symmetrically. A requirement for the present invention is to provide the intermediate holding portion 3 between the strip-cut shredding portion 1 and the cross-cut shredding portion 2 so that the intermediate holding portion 3 can feed the strip-cut waste pieces Q1 discharged from the strip-cut shredding portion 1 to the cross-cut shredding portion 2 while holding the strip-cut waste pieces Q1.

While the forms of apparatus and methods herein described constitute preferred embodiments of this invention, it is to be understood that the invention is not limited the these precise forms of methods and apparatus, and that changes may be made therein without departing from the scope of the invention.

What is claimed is:

1. A shredder comprising:

a strip-cut shredding portion including paired disc-shaped multi-plate rotary cutters engaged with each other to shred paper in a strip-cut direction;

a cross-cut shredding portion including a fixed cutter and a spiral rotary cutter for further shredding strip-cut waste pieces discharged from the strip-cut shredding portion in a cross-cut direction, on a downstream side of the strip-cut shredding portion;

an intermediate holding portion, provided between the strip-cut shredding portion and the cross-cut shredding portion, for feeding the strip-cut waste pieces to the cross-cut shredding portion while holding the strip-cut waste pieces, wherein the intermediate holding portion includes paired rollers which have smaller diameters than those of the respective paired disc-shaped multi-plate rotary cutters and outer peripheral faces capable of coming into close contact with each other to pinch the strip-cut waste pieces, and the paired rollers rotate in a feed direction;

power transmitting gears provided between the multi-plate disc-shaped rotary cutters and the paired rollers, for transmitting rotary power of the multi-plate disc-shaped rotary cutters to the paired rollers, wherein the paired rollers are rotated in the feed direction at higher circumferential speeds than circumferential speeds of the disc-shaped multi-plate rotary cutters via the power transmitting gears; and one-way clutches between the paired rollers and the power transmitting gears, wherein the paired rollers are rotated in the feed direction when the multi-plate disc-shaped rotary cutters rotate normally, and the one-way clutches interrupt power transmission to cause the paired rollers to rotate freely when the disc-shaped multi-plate rotary cutters rotate reversely.

2. The shredder according to claim 1, wherein a portion of the intermediate holding portion for pinching the strip-cut waste pieces with the paired rollers is positioned on a tangent passing through an engaged portion of the paired disc-shaped multi-plate rotary cutters.

3. The shredder according to claim 1, further comprising guide portions provided between the intermediate holding portion and the strip-cut shredding portion and capable of guiding the strip-cut waste pieces into a correct discharge direction between the paired rollers.

4. The shredder according to claim 1, wherein at least one of the paired rollers is resiliently variable in force to come in close contact with the outer peripheral face of the other roller.

* * * * *